US009683307B2

(12) United States Patent
Arai et al.

(10) Patent No.: US 9,683,307 B2
(45) Date of Patent: Jun. 20, 2017

(54) PARTIAL PLATING DEVICE AND PARTIAL PLATING METHOD

(71) Applicant: DOWA METALTECH CO., LTD., Tokyo (JP)

(72) Inventors: Kentaro Arai, Saitama (JP); Hiroshi Miyazawa, Saitama (JP)

(73) Assignee: DOWA METALTECH CO., LTD., Tokyo (JP)

( * ) Notice: Subject to any disclaimer, the term of this patent is extended or adjusted under 35 U.S.C. 154(b) by 272 days.

(21) Appl. No.: 14/351,713

(22) PCT Filed: Oct. 18, 2012

(86) PCT No.: PCT/JP2012/006669
§ 371 (c)(1),
(2) Date: Apr. 14, 2014

(87) PCT Pub. No.: WO2013/057947
PCT Pub. Date: Apr. 25, 2013

(65) Prior Publication Data

US 2014/0291159 A1 Oct. 2, 2014

(30) Foreign Application Priority Data

Oct. 19, 2011 (JP) ..... 2011-229476
Mar. 26, 2012 (JP) ..... 2012-068705

(51) Int. Cl.
*C25D 17/06* (2006.01)
*C25D 17/00* (2006.01)
(Continued)

(52) U.S. Cl.
CPC ..... *C25D 17/06* (2013.01); *C25D 5/022* (2013.01); *C25D 7/0635* (2013.01);
(Continued)

(58) Field of Classification Search
CPC .... C25D 17/06; C25D 7/0635; C25D 7/0671; C25D 5/022
See application file for complete search history.

(56) References Cited

U.S. PATENT DOCUMENTS 4,493,757 A * 1/1985 Piepers ..... C25D 5/02 204/202

FOREIGN PATENT DOCUMENTS

JP 57-203790 12/1982
JP 59-109772 7/1984
(Continued)

OTHER PUBLICATIONS

International Search Report in PCT/JP2012/006669, mailed Jan. 29, 2013, along with an English translation thereof.

*Primary Examiner* — Louis Rufo
(74) *Attorney, Agent, or Firm* — Greenblum & Bernstein P.L.C.

(57) ABSTRACT

A partial plating device includes a drum jig which has a plurality of positioning pins provided on the outer peripheral surface thereof, and which feeds a metal member around the outer periphery thereof by engaging the metal member with the positioning pins; a rotating shaft which rotatably supports the drum jig, a jet unit that supplies plating liquid to the metal member, and a brake unit that reduces the circumferential speed of the drum jig, and which is fitted to the rotating shaft. A plating device and a partial plating method in which plating is not carried out on the first region of a metal member on the carrying-in side of the drum jig, but in which plating is carried out on the second region of a metal member on the carrying-out side.

17 Claims, 11 Drawing Sheets

(51) Int. Cl.
*C25D 7/06* (2006.01)
*C25D 5/02* (2006.01)

(52) U.S. Cl.
CPC ..... *C25D 7/0671* (2013.01); *C25D 7/0685* (2013.01); *C25D 17/00* (2013.01)

(56) References Cited

FOREIGN PATENT DOCUMENTS

| | | |
|---|---|---|
| JP | 2006-283127 | 10/2006 |
| JP | 2009-242859 | 10/2009 |

* cited by examiner

| | Ave. [μm] | Max. [μm] | Min. [μm] | Range [μm] | σ | NUMBER OF PIECES OF DATA (PIECE) (FOR ONE ROTATION OF DRUM) |
|---|---|---|---|---|---|---|
| NO LOAD APPLIED TO DRUM | 0.45 | 0.52 | 0.31 | 0.21 | 0.049 | 150 |
| LOAD OF 4kgf APPLIED TO DRUM (FIRST EMBODIMENT) | 0.53 | 0.57 | 0.43 | 0.14 | 0.022 | 150 |

| | Ave. [μm] | Max. [μm] | Min. [μm] | Range [μm] | σ | NUMBER OF PIECES OF DATA (PIECE) (FOR ONE ROTATION OF DRUM) |
|---|---|---|---|---|---|---|
| LOAD OF 4kgf APPLIED TO DRUM (FIRST EMBODIMENT) | 0.53 | 0.57 | 0.43 | 0.14 | 0.022 | 150 |
| LOAD OF 4kgf APPLIED TO DRUM+ SMALLER ANODES (SECOND EMBODIMENT) | 0.43 | 0.45 | 0.42 | 0.03 | 0.006 | 150 |

PARTIAL PLATING DEVICE AND PARTIAL PLATING METHOD

This application claims priority from Japanese Patent Application Numbers JP2011-229476 (filed on Oct. 19, 2011) and JP2012-068705 (filed on Mar. 26, 2012), the content of which is incorporated herein by reference in its entirety.

TECHNICAL FIELD

The present invention relates to a partial plating apparatus being configured to partially plate a metal member made of copper (Cu), a Cu alloy, iron (Fe), an Fe alloy, or the like, and capable of reducing variations in the thickness of plated films.

BACKGROUND ART

A partial plating apparatus using a cylindrical jig (drum jig) is known as a partial plating apparatus for partially plating an elongated metal member. FIG. 10 is a top view schematically showing a drum jig 201 of a conventional partial plating apparatus 200.

The plating apparatus 200 with the drum jig is an apparatus configured to perform plating by a continuous feed method. Specifically, an elongated metal member 202 which is to be plated is wound around an outer circumferential surface of the drum jig 201. Then, while the metal member 202 is moving, a plating solution is supplied from about the center of the drum jig 201 to the surface of the metal member 202, as indicated by the broken-line arrows, through opening portions (not shown) provided in the outer circumferential surface of the drum jig. Since portions other than the opening portions are masked by the drum jig, the plating material is not deposited on those other portions. Thereby, the metal member can be partially plated. Such a plating method is called spot plating.

In such a partial plating apparatus, multiple positioning pins 203 are provided on the outer circumferential surface of the drum jig 201. By causing these positioning pins 203 to engage with guide holes (not shown) provided in the metal member 202 and moving the metal member 202 at a predetermined velocity, the drum jig 201 rotates. Although seven positioning pins 203 are shown to provide an overview, eight or more positioning pins 203, for example, are actually provided (the same is true hereinbelow).

The drum jig 201 is supported by a rotary shaft 204 while being able to rotate around the rotary shaft 204, and unless an external force for driving the drum jig 201 is applied thereto, the drum jig 201 rotates at the same circumferential velocity as the moving velocity of the metal member 202, as indicated by the thin-line arrows.

There is also known a partial plating apparatus configured to press an inner circumferential surface of a drum jig rotating along with the movement of a metal member and to change the circumferential velocity of the drum jig by adjusting this pressing force (refer to, for example, patent document 1).

CITATION LIST

Patent Document

Patent Document 1: Japanese Patent Application Publication No. 2009-242859

SUMMARY OF THE INVENTION

Problems to be Solved by the Invention

Plating processing performed with the conventional partial plating apparatus shown in FIG. 10 causes a problem where there are noticeable variations in the distribution of the plated-film thickness on a plated product.

FIG. 11 shows diagrams illustrating a relation between the drum jig 201 of the partial plating apparatus 200 and the metal member 202 in FIG. 10. Specifically, FIGS. 11A and 11B are top views, FIG. 11C is a spread-out top view of FIG. 11B, and FIG. 11D is an enlarged diagram of a portion in FIG. 11C circled by a broken line.

First, FIGS. 11A and 11B are diagrams illustrating positional relations between the positioning pins 203 of the drum jig 201 and the guide holes of the metal member 202 engaging therewith respectively. The metal member 202 is an elongated member whose length is, for example, ten times or more larger than its width. In FIGS. 11A and 11B, the width of the metal member 202 is along a depth direction, and the length thereof is along a left-right direction. Here, FIGS. 11A and 11B show the guide holes h1 to h10 in a plan view so that their shapes can be seen (viewed on a main surface of the metal member 202), and show positions of engagement between the positioning pins and the corresponding guide holes h1 to h10. Note that the guide holes h1 to h10 are collectively referred to as guide holes h hereinbelow when they do not need to be discriminated from one another.

The metal member 202 is a thin plate which is elongated as described above and has a thickness of, for example, no more than about 0.8 mm. The drum jig 201 and the metal member 202 are designed so that a spacing distance (pitch) p1' between every adjacent ones of the positioning pins 203 may coincide with a spacing distance (pitch) p2' between every adjacent ones of the guide holes h of the metal member 202. However, a certain clearance is necessary between the guide hole h and the positioning pin 203, and also considering that the drum jig 201 is cylindrical, it is practically impossible, in view of processing accuracy, to make the positioning pins 203 and the guide holes h completely coincide with each other.

To be more specific, the difference per pitch between the pitch p1' of the positioning pins 203 and the pitch p2' of the guide holes h which is allowed to make them completely coincide with each other (called a pitch difference between the guide hole and the positioning pin) is equal to or beyond the processing-accuracy limit for the drum jig 201. Hence, the jig cannot be manufactured within this pitch difference. In addition, since the drum jig 201 expands during plating processing due to the temperature of a plating solution, this factor needs to be considered at the design phase. This makes it even more impossible to keep the pitch difference within the allowable range.

For example, since the drum jig 201 is designed to aim the pitch p1'=the pitch p2' and manufactured with a±tolerance, the pitch relation may result in the pitch p1'<the pitch p2' or the pitch p1'>the pitch p2'.

For these reasons, there occurs a pitch difference between the guide holes and the positioning pins. Repetition of accumulation and cancellation of this pitch difference during a manufacture process leads to a problem of variations in the distribution of the plated-film thickness.

Referring to FIG. 11A, the metal member 202 is moving from an entry point I side to an exit point O side, as indicated by the arrows. With a distance between the head of the metal member 202 to be plated and the exit point O being L1, if the pitch p1' of the positioning pins 203 of the drum jig 201 is slightly smaller than the pitch p2' of the guide holes h of the metal member 202 (if p1'<p2' as a result), the positioning pins 203 engage with the respective guide holes h1 to h7 of the metal member 202, as shown in FIG. 11A.

From the exit point O side of the drum jig 201 to the entry point I side of the drum jig 201, the engagement positions of the positioning pins 203 in the guide holes h of the metal member 202 are shifted more and more forward in the travelling direction (toward the exit point O for the metal member 202), each by the amount of the pitch difference. Meanwhile, as the metal member 202 moves from the entry point I side to the exit point O side as indicated by the arrows, the drum jig 201 rotates about the rotary shaft 204 due to a frictional force acting between the drum jig 201 and the metal member 202. In other words, in this case, the drum jig 201 rotates in the moving direction of the metal member 202 at a circumferential velocity v1' which is equivalent to a moving velocity v2' of the metal member 202.

Referring to FIG. 11B, as the metal member 202 further moves on making the distance between the head of the metal member 202 and the exit point O L2 (L1<L2), the guide hole h4, for example, of the metal member 202 engages with the endmost positioning pin 203 at the exit point O side, and the guide holes h8 to h10 newly engage with their corresponding positioning pins 203.

As shown in FIG. 11B, even after the guide holes h1 to h3 separate from the drum jig 201, the drum jig 201 keeps rotating due to the frictional force acting between itself and the metal member 202 and therefore rotates at the same circumferential velocity v1' as the moving velocity v2' of the metal member 202. Thus, the positional relations between the positioning pins and the guide holes shown in FIG. 11A are maintained. Then, at the guide hole h8, the pitch differences from the guide hole h4 to the guide hole h8 are accumulated (this is called an accumulated pitch difference hereinbelow).

Thus, as shown in FIGS. 11C and 11D, at the guide hole h8 for example, the positioning pin 203 comes into contact with an end portion of the guide hole h8 by exceeding the clearance between the guide hole h8 and the positioning pin 203. As a result, the metal member 202 slightly separates from the drum jig 201 (see FIG. 11D).

In other words, when the guide hole h and the positioning pin 203 come into contact with each other due to the accumulation pitch difference therebetween, separating the metal member 202 from the drum jig 201, the distribution of the plated-film thickness is locally low. Then, there occurs a problem where, when the accumulation and cancellation of the pitch difference are repeated, a single metal member has large variations in its plated-film thickness.

This also depends on the area of each plated portion (spot). Specifically, even when the partial plating apparatus shown in FIG. 10, i.e., the continuous-feed partial plating apparatus is used for plating, the variations in the plated-film thickness are not problematic if the area of each plated portion is rather large.

In recent years, however, with a size reduction in various electronic devices and their components, the area of each plated portion (spot) of a plated product is reduced more and more (e.g., 5 mm×5 mm or less). With this, the problem of the variations in the plated-film thickness is more noticeable than before.

To overcome this problem, it is conceivable to cancel out the pitch difference between the guide hole h of the metal member 202 and the positioning pin 203 of the drum jig 201.

For example, Patent Document 1 discloses a technique for pressing a rubber roller against a drum jig (cylindrical drum) and adjusting this pressing force to adjust the circumferential velocity of the drum jig.

However, it is extremely difficult to control the moving velocity of the metal member and the circumferential velocity of the drum jig independently.

Specifically, in the technique described in Patent Document 1, the rubber roller is pressed against the drum jig which is being rotated at a constant velocity by a motor, and the circumferential velocity of the drum is controlled by controlling the strength of the pressing force.

Assume, for example as general numerical values, that the length of the metal member 202 is 2000 m, the clearance between the guide hole h and the positioning pin 203 is 0.5 mm, and the moving velocity of the metal member is 2 m/min. Then, an allowable error in the circumferential velocity of the drum jig 201 is 0.5 μm/min.

Thus, the circumferential velocity of the drum jig being rotated by the motor needs to be independently controlled so that the error will not exceed the above range, and to do this, for example, means for monitoring the clearance and feeding back or the like is necessary. Specifically, Patent Document 1 controls the circumferential velocity by monitoring the clearance by use of a laser, image processing, or the like so that the error will not exceed the allowable range and feeding back the monitor result.

However, a structure needing such feedback means has problems such as involving complicated control and increasing equipment costs.

Mean for Solving the Problems

The present invention has been made in view of the above problems which are to be solved by, firstly, providing a partial plating apparatus including: a drum jig having a plurality of positioning pins arranged on an outer circumferential portion thereof so that a metal member engages with the positioning pins to be transported along the outer circumferential portion; a rotary shaft configured to support the drum jig such that the drum jig is rotatable; a jet portion configured to supply a plating solution to the metal member; and a brake unit attached to the rotary shaft and configured to reduce a circumferential velocity of the drum jig.

In this way, the present invention manufactures the drum jig such that the pitch of the positioning pins may be slightly smaller than the pitch of the guide holes, provides the rotary shaft supporting the drum jig with the brake unit configured to slow down the drum jig, and thereby cancels out the accumulation pitch difference between the guide hole of the metal member and the positioning pin of the drum jig. The brake unit causes the drum jig to move (slide) in an opposite direction relative to the metal member within the clearance between the guide hole and the positioning pin, and thereby the accumulated pitch difference is cancelled.

Secondly, the above problems are solved by providing a partial plating method for performing partial plating on a metal member transported along an outer circumferential portion of a drum jig of a partial plating apparatus. In this method, part of the outer circumferential portion of the drum jig is a contact region where the drum jig is in contact with the metal member and which has a first region and a second region, the first region extending over a predetermined distance from an end portion of the contact region on a side where the metal member enters, the second region extending from an end portion of the first region to an end portion of the contact region on a side where the metal member exits, the metal member is not plated in the first region, and the metal member is plated in the second region.

In this way, the present invention reduces variations in the thickness of plated films by performing plating only in the second half of the contact region.

Advantageous Effects of Invention

According to the partial plating apparatus of the present invention, firstly, is provided a continuous-feed partial plating apparatus using a drum jig capable of reducing variations in the distribution of the film thicknesses on a plated product.

In the partial plating apparatus, the brake unit is provided at the rotary shaft supporting the drum jig such that the drum jig is rotatable, and applies a load to the rotary shaft to make the circumferential velocity of the drum jig lower than the moving velocity of the metal member. Thereby, the accumulated pitch difference between the guide hole of the metal member and the positioning pin of the drum jig which is created during the plating processing is continually cancelled, reducing variations in the thickness of the plated films.

The load applied by the brake unit to the rotary shaft is maintained to be larger than a force with which the drum jig moves (slides) in a direction opposite from the travelling direction of the metal member with which the drum jig is in contact, but not larger than a force causing deformation of the metal member.

Thereby, the accumulated pitch difference between the guide hole and the positioning pin created while one elongated metal member is processed is continually cancelled (not accumulated), allowing every positioning pin to be within the clearance between the positioning pin and its corresponding guide hole.

The drum jig of the embodiments herein is configured not to control its own rotation, but to rotate along with the movement of the metal member, and is slowed down by the brake unit. In other words, without additional feedback means or clearance monitoring means, engagement between the guide hole and the positioning pin can be ensured over the entire metal member only by maintaining the load applied by the brake unit to the rotary shaft to be within a predetermined range. Thus, the circumferential velocity of the drum jig does not need to be controlled, and the equipment is simple and requires low costs.

Further, the pitch of the positioning pins of the drum jig is designed to be smaller than the pitch of the guide holes of the metal member, and the brake unit reduces the circumferential velocity of the drum jig relative to the moving velocity of the metal member during the plating processing. Thereby, when the metal member enters the drum jig, the position pin is located forward (toward the exit side), in the travelling direction, of the center of the corresponding guide hole, and when metal member exits the drum jig, the positioning pin is located rearward (toward the entry side) of the center of the guide hole. Thus, biting at the entry and the exit can be reduced.

Secondly, at the contact region where the drum jig and the metal member are in contact with each other, the metal member is not plated in the first region on the metal-member entry side, and the metal member is plated in the second region on the metal-member exit side. With such a structure, the distribution of the film thickness can be evened out furthermore.

Since reduction in film thickness occurs noticeably in the first half of the contact region, the plating processing is performed not in this first half, but only in the second half extending from the middle area (second region). Thus, counter electrodes (anodes) are provided only in the second region, or a jet portion configured to eject a plating solution only to the second region is employed. Thereby, the film-thickness distribution can be evened out furthermore.

Thirdly, according to the partial plating method of the present invention, the metal member is plated not in the first half (the first region) of the drum jig, but only in the second region. For this reason, variations in the distribution of the plated-film thickness can be reduced, compared to a plating method which performs plating on the entire contact region.

DESCRIPTION OF EMBODIMENTS

Embodiments of the present invention are described with reference to FIGS. 1 to 9. First, a first embodiment of the present invention is described with reference to FIGS. 1 to 4.

Figure 1A:
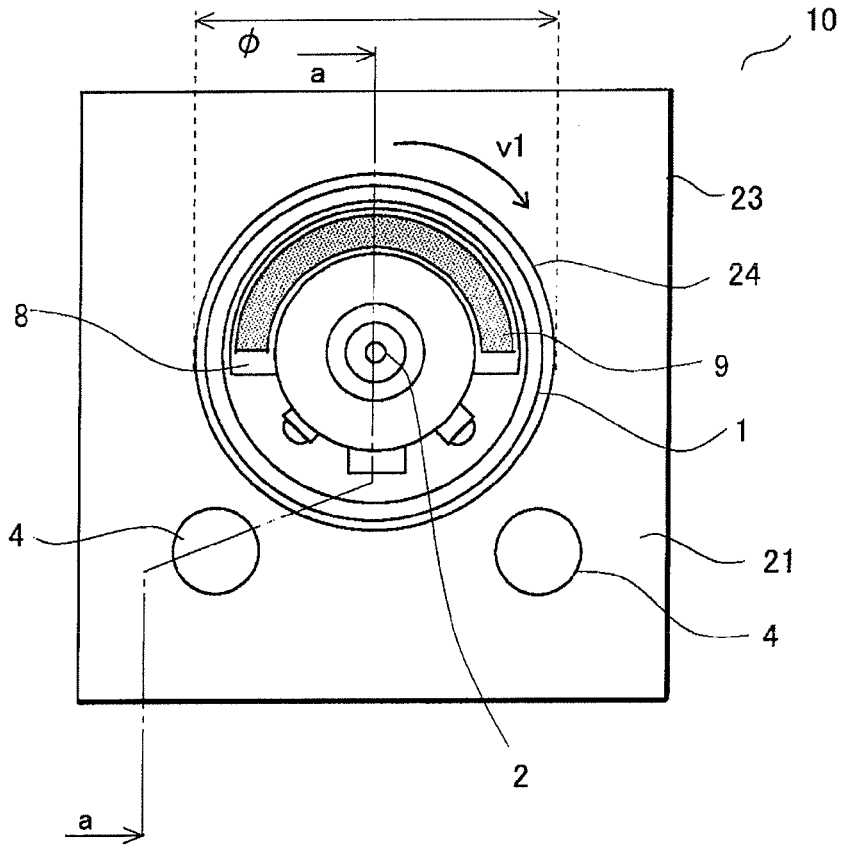
FIG. 1A is a top view illustrating a partial plating apparatus according to a first embodiment of the present invention.
Figure 1B:
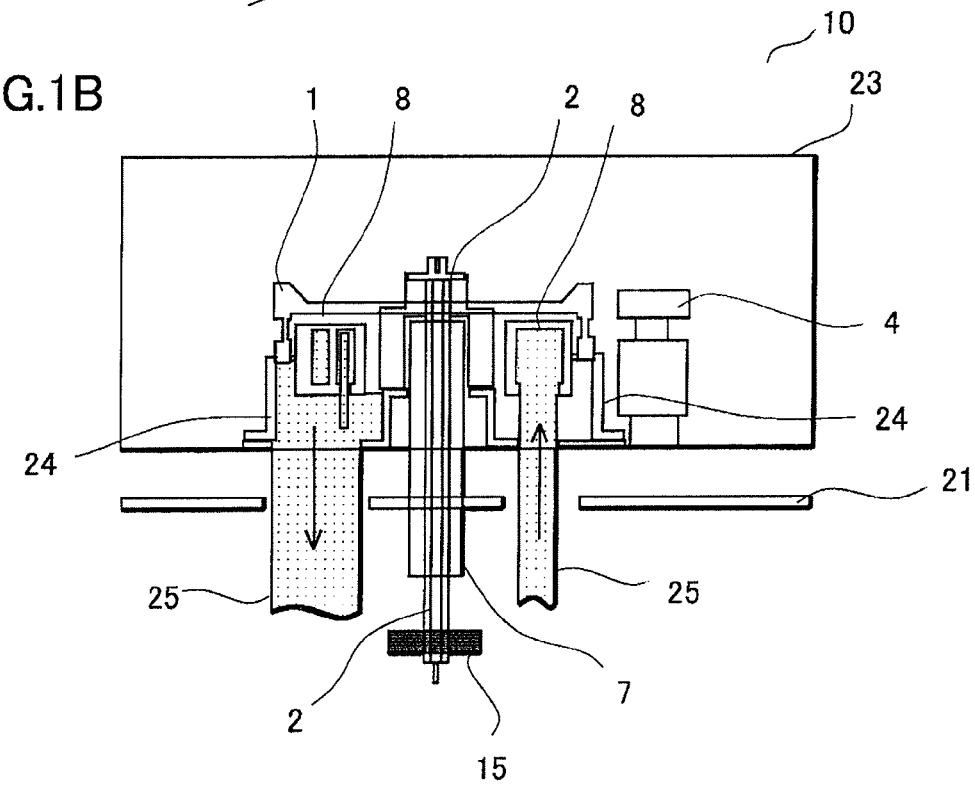
FIG. 1B is a sectional view thereof.

FIG. 1 shows schematic diagrams illustrating the structure of a partial plating apparatus 10 of the first embodiment. Specifically, FIG. 1A is a top view thereof also showing its underlayer (internal) structure transparently, and FIG. 1B is a sectional view taken along line a-a in FIG. A.

Referring to FIG. 1, the partial plating apparatus 10 has a drum jig 1, a rotary shaft 2, a jet portion 8, and a brake unit 15.

The drum jig 1 is a jig configured to bring a metal member (not shown here) being a member to be plated, into a close contact with an outer circumferential portion thereof and transport the metal member along with the outer circumferential portion. The drum jig 1 is rotatable about the rotary shaft 2, but there is no driving means for rotating the drum jig 1. In other words, when the metal member moves at a predetermined velocity, the drum jig 1 rotates at a predetermined circumferential velocity v1 in the same direction as the metal member travels, e.g., the arrowed direction in FIG. 1A. For example, a drum diameter ϕ of the drum jig 1 is preferably 200 mm to 500 mm. When the drum diameter ϕ is smaller than 200 mm, productivity might be lowered since it is hard to wind the metal member (although it depends on the thickness of the metal member), or the plating time is shortened to decrease a so-called line speed. When the drum diameter ϕ is larger than 500 mm, problems such as the following arise: difficulty of manufacturing (processing) the partial plating apparatus, larger influence by the eccentricity of the drum jig 1, and increase in initial costs. On the outer circumferential portion of the drum jig 1, multiple positioning pins (not shown here) are arranged such that they are spaced away from each other at equal distances (pitch).

The rotary shaft 2 is supported by a support column 7 and thereby fixed to a base plate 21. One end of the rotary shaft 2 (the upper end in FIG. 1B) is fixed to the drum jig 1 which is thereby rotatably supported. The other end (the lower end in FIG. 1B) is attached to the brake unit 15.

The brake unit 15 is attached to a lower end portion of the rotary shaft 2 which is located below the base plate 21, and applies a predetermined load to the drum jig 1. Thereby, the circumferential velocity v1 of the drum jig 1 being plated is reduced to be lower than the moving velocity of the metal member.

The brake unit 15 applies the load by pressing the rotary shaft 2 from its outer side (outer circumference), and employs a braking method capable of linearly controlling a pressure parameter in a low-load region. The pressure parameter is, for example, air pressure.

More specifically, the brake unit 15 employs a disk brake method which puts a brake by using an air pressure. The load is controlled with the air pressure maintained constant by, for example, a compressor and a regulator, and the load is maintained almost constant while a single metal member is being plated.

An appropriate value is selected for the load by changing an air pressure to be fed into the brake unit 15, according to the material, plate thickness, and width of the metal member, the tension of the metal member (a pulling force exerted on the metal member in the plating processing line), the drum diameter ϕ and weight of the drum jig 1, an angle at which the metal member is wound around the drum jig 1, and the like.

For example, a small load is set when the metal member has a small plate thickness or is made of a material which easily causes deformation of the guide holes h. Further, a large load is set in cases such as where the metal member is made of a material causing a large frictional force to act between the metal member and the drum jig 1 (hard to slip) or has a large tension so that a large frictional force acts between the metal member and the drum jig 1.

Note that the brake method of the brake unit 15 is not limited to this example as long as it is a method capable of linearly controlling the pressure parameter in the low-load region.

The jet portion 8 supplies a plating solution (indicated by hatching) to the metal member via the drum jig 1. The plating solution is accommodated in a supply tank (not shown) outside a process tank 23, and drawn from the supply tank with a pump or the like (not shown) to the jet portion 8 through piping 25, as indicated by the upward arrow. The plating-solution supply tank is provided with a heater, a temperature sensor, an adjustor, and the like to keep the temperature of the plating solution to be constant. Further, the pump includes an inverter for controlling the flow rate, and controls the flow rate. The jet portion 8 collects the plating solution ejected to the metal member into the supply tank through the piping 25, as indicated by the downward arrow.

A liquid protection dam 24 is provided around an outer circumference of the jet portion 8, and the drum jig 1 is placed on an upper portion of an inner circumferential portion of the liquid protection dam 24 and covers the jet portion 8. Support rollers 4 support movement of the metal member wound around the drum jig 1.

Counter electrodes (anodes) 9 are provided at a plating-solution ejection vent of the jet portion 8. The jet portion 8 has, for example, a substantially semi-circular shape in the plan view of FIG. 1A, and the anodes 9, too, have a substantially semi-circular shape along the shape of the jet portion 8.

Figure 2A:
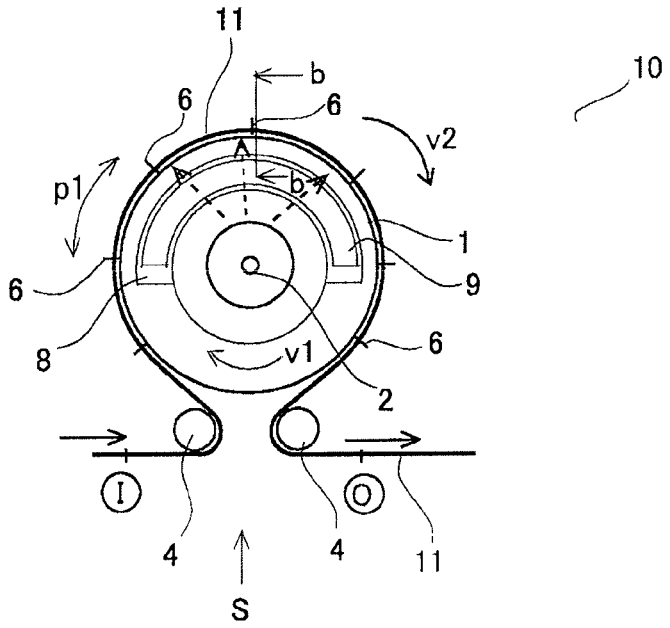
FIG. 2A is a top view illustrating the partial plating apparatus according to the first embodiment of the present invention.
Figure 2B:
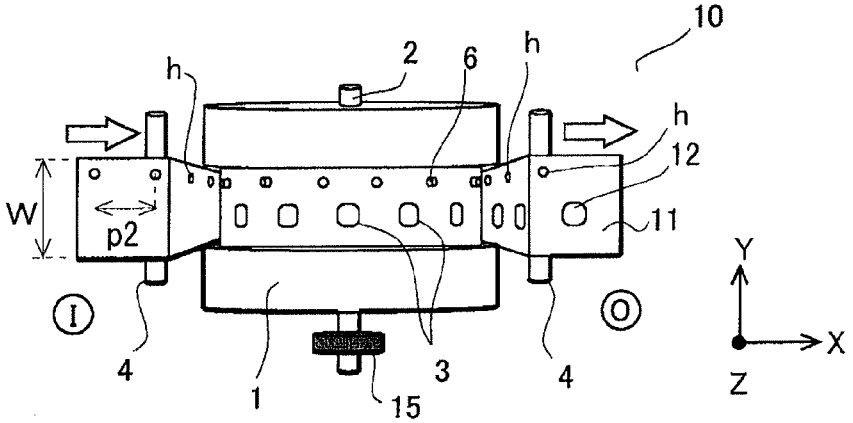
FIG. 2B is a side view thereof.
Figure 2C:
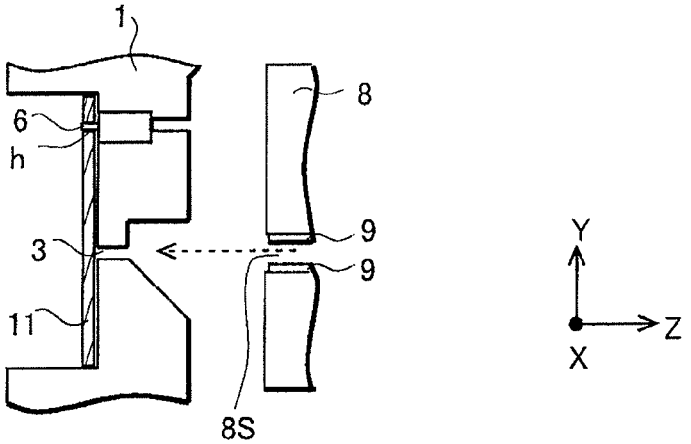
FIG. 2C is a sectional view thereof.

The drum jig 1 is further described with reference to FIG. 2. FIG. 2A is a schematic top view showing a state where a metal member 11 is wound around the drum jig 1 shown in FIG. 1A, FIG. 2B is a side view showing the state from an S-direction point of view in FIG. 2A, and FIG. 2C is a diagram showing part of a section taken along line b-b in FIG. 2A.

Multiple positioning pins 6 are arranged on the outer circumferential portion of the drum jig 1 at equal spacing distances (pitch p1). Although only seven positioning pins 6 are arranged herein to give an overview, eight or more positioning pins 6, for example, are actually arranged on the outer circumferential portion of the drum jig 1.

The metal member 11 engages with the positioning pins 6 and is thereby transported along the outer circumferential portion of the drum jig 1 from an entry point I to an exit point O as indicated by the arrows. The drum jig 1 of this embodiment rotates along with the movement of the metal member 11.

As indicated by the broken-line arrows, a plating solution is supplied to the metal member 11 from the jet portion 8 provided inside the drum jig 1.

Referring to FIG. 2B, the positioning pins 6 are provided on the outer circumferential surface of the drum jig 1. The multiple positioning pins 6 are arranged in the circumferential direction. The metal member 11 is also provided with multiple guide holes h which correspond to the positioning pins 6. The guide holes h are spaced away from one another at equal spacing distances (pitch p2).

The guide holes h of the metal member 11 engage with the positioning pins 6, and the metal member 11 is pulled in the arrowed direction. Thereby, the metal member 11 is brought into a close contact with part of the outer circumferential portion of the drum jig 1, and a frictional force acting therebetween causes the drum jig 1 to rotate.

In this embodiment, the metal member 11 is transported along the outer circumferential portion of the drum jig 1 with its width W direction (Y direction in FIG. 2B) being vertical. The width W direction is a direction orthogonal to a long-side direction (X direction) of the elongated metal member 11.

The rotation of the drum jig 1 is not controlled by any driving means such as a motor. Instead, when the metal member 11 moves, the drum jig 1 rotates in the travelling direction of the metal member 11 (in the same direction as far as a surface thereof in contact with the metal member 11 is concerned). However, the average circumferential velocity v1 of the drum jig 1 is reduced by the brake unit 15 to be lower than the moving velocity v2 of the metal member (see FIG. 1A). To be more specific, the brake unit 15 gives the rotary shaft 2 a load which is larger than a force with which the metal member 11 and the drum jig 1 in contact with each other move (slide) in opposite directions, but not larger than a force causing deformation of the metal member 11.

In this way, the drum jig 1 which rotates at the circumferential velocity equivalent to the moving velocity of the metal member 11 when no load is applied thereto can be slowed down. By setting a lower limit of the load of the brake unit 15 within the above range, the drum jig 1 rotates slightly more slowly than the metal member 11 and slides on the metal member 11, and thus the metal member 11 and the drum jig 1 move in relatively opposite directions (i.e., they slide on each other).

As an example, when the metal member 11 which is made of a Cu (copper) alloy and is 0.2 mm thick and 30 mm wide is moved under a tension of 4 kgf, a load to be given by the brake unit 15 is set to about 4 kgf. In this case, supposing that the pitch p2 of the guide holes h is 10 mm/pitch and a pitch difference between one guide hole h and a corresponding positioning pin 6 is, for example, 0.003 mm, the average velocity v1 of the drum jig 1 is reduced by 0.03% relative to the moving velocity v2 of the metal member 11.

On the outer circumferential portion of the drum jig 1, multiple opening portions 3 are arranged along the circumferential direction of the column. A material for the drum jig 1 is a resin with low thermal expansion, and is, for example, a heat-resistant vinyl chloride resin, a polyphenylene sulfide (PPS) resin, a polyetheretherketone (PEEK) resin, or the like.

Referring to FIG. 2C, the plating solution is supplied to the metal member 11 from the ejection vent (slit portion 8S) of the jet portion 8, as indicated by the broken-line arrow, through the opening portions 3 provided in the drum jig 1. The counter electrodes (anodes) 9 are provided inside the drum jig 1 to face the metal member 11. For example, the counter electrodes 9 are provided at an upper portion and a lower portion of the slit portion 8S, respectively. A voltage is applied between the metal member 11 and the counter electrodes 9 to produce currents via the plating solution.

By passing currents through the plating solution, plated films 12 are formed on the metal member 11. More specifically, the plated films 12 each having the shape of the opening portion 3 are formed by spot plating on the metal member 11 in such a manner as to form a line, for example, in the long-side direction of the metal member 11. The plated film 12 is, for example, a gold (Au) plated film whose four sides are each, for example, 5 mm or less long. Prior to the spot plating of Au, base plating of nickel (Ni), an Ni alloy, Cu, a Cu alloy, or the like may be performed on the metal member 11 (see FIG. 2B).

In this embodiment, the drum jig 1 and a mask for forming the plated films are integrated with each other. To be more specific, when a plating solution is ejected from the jet portion 8 to the metal member 11 as indicated by the arrow through the opening portions, the area excluding the opening portions 3 is covered by the drum jig 1, and portions of the drum jig 1 around the opening portions 3 act as a mask for forming the plated films.

Note that the present invention is not limited to this, and may be configured such that a resin mask member having the opening portions 3 is wound around the outer circumferential portion of the drum jig 1. In this case, the drum jig 1 has a structure such as the following. Specifically, the drum jig 1 is provided with a slit running along the circumference of the outer circumferential portion thereof, for example, so that the plating solution can be supplied from the jet portion 8, and the mask member is provided on the outer circumferential portion such that the opening portions 3 thereof coincide with the slit.

In contrast to this structure, the drum jig 1 in this embodiment serves also as a mask. Thus, mask misalignment can be prevented.

Next, with reference to FIG. 3, a description is given of a relation that the metal member 11 and the drum jig 1 have to each other while the partial plating apparatus 10 is performing its plating processing.

Figure 3A:
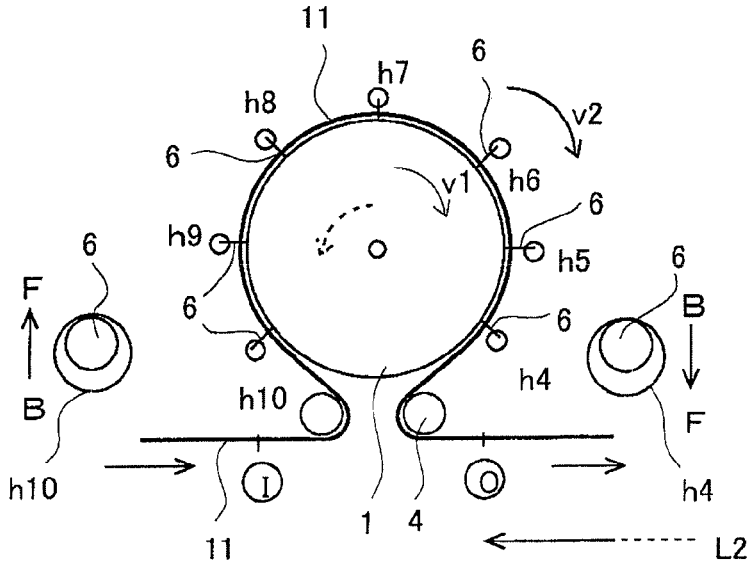
FIG. 3A is a top view illustrating the partial plating apparatus according to the first embodiment of the present invention.
Figure 3B:
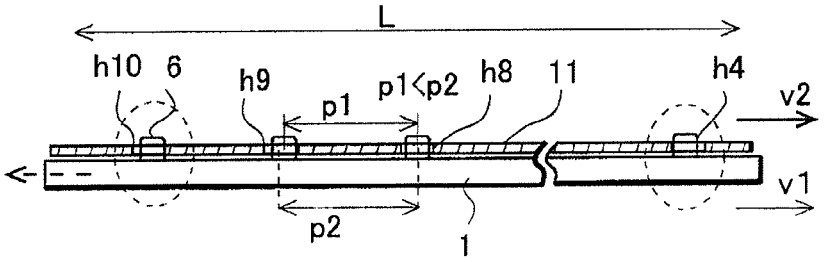
FIG. 3B is a spread-out top view thereof.

FIGS. 3A and 3B are diagrams illustrating a positional relation between each positioning pin 6 of the drum jig 1 and the guide hole h of the metal member 11 engaging with this positioning pin 6. The guide holes h in FIG. 3A are depicted as described earlier. Specifically, the guide holes h (h4 to h10 here) are actually provided to penetrate through two main surfaces (front and back surfaces) of the metal member 11, each main surface being formed by sides extending in the width W direction and sides extending in the length L direction. However, the guide holes h4 to h10 are shown here in a plan view (as in FIG. 3B) so that their shapes and the positions of engagement between them and the corresponding positioning pins can be seen. Further, FIG. 3A also provides a plan view (plan view seen from the main surface side of the metal member 11) for each of the guide holes h4 and h10 to show the clearance between the guide hole h and the positioning pin 6.

Figure 3C:
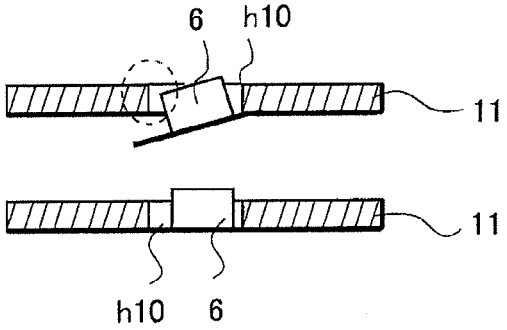
FIG. 3C is an enlarged top view thereof, and 3D is an enlarged top view thereof.
Figure 3D:
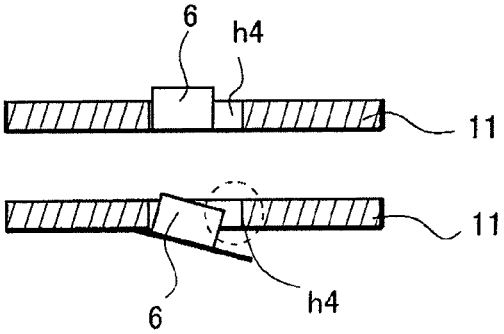

FIG. 3B is a top view in which the drum jig 1 and the metal member 11 in FIG. 3A are spread out linearly. FIGS. 3C and 3D are enlarged top view of the guide holes h10 and h4, respectively, circled by the broken lines in FIG. 3B.

Referring to FIGS. 3A and 3B, the guide holes h of the metal member 11 and the positioning pins 6 of the drum jig 1 engage with each other, and the metal member 11 is transported, thereby rotating the drum jig 1. The positioning pins 6 are formed on the drum jig 1 along the circumference thereof and protrude by an amount equal to the plate thickness of the metal member 11. The diameter of each positioning pin 6 (e.g., 1.0 mm) has a certain clearance with respect to the diameter of each guide hole h (e.g., 1.5 mm). In this embodiment, the drum jig 1 is designed and manufactured with a minus tolerance so that the pitch p1 of the positioning pins may be smaller than the pitch p2 of the guide holes h.

Figure 11A:
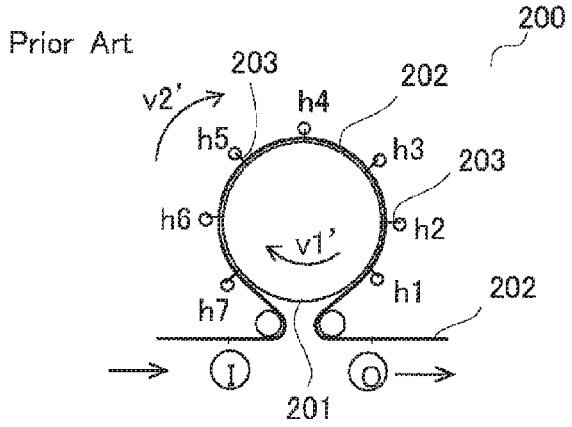
FIG. 11A is a top view illustrating the conventional structure.
Figure 11B:
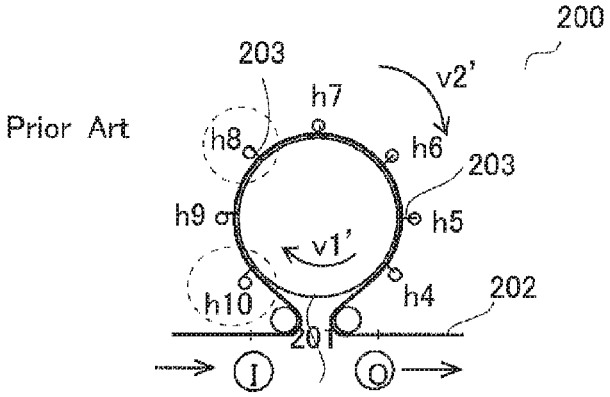
FIG. 11B is a top view thereof.
Figure 11C:
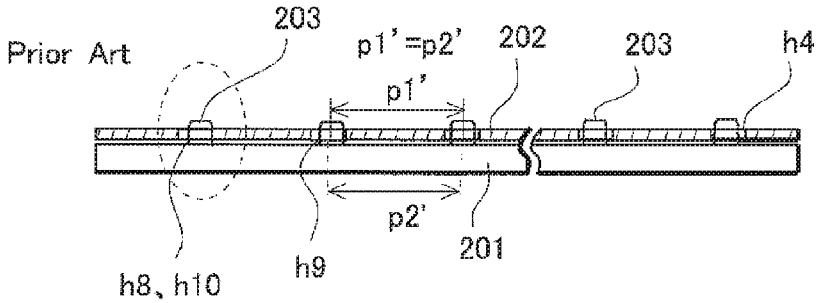
FIG. 11C is a spread-out top view thereof.

FIG. 3 shows a relation that the drum jig 1 and the metal member 11 have when the distance between the head of the metal member 11 to be plated and the exit point O is L2 (i.e., corresponding to the state in FIG. 11B).

In this embodiment as well, the positioning pins 6 engage with the respective guide holes h at different positions as shown in FIG. 3.

For example, in the state shown in FIG. 3, the endmost positioning pin 6 of the drum jig 1 on the exit point O side engages with the guide hole h4 such that it is in contact with an end portion of the guide hole h4 on a rear B side (the entry point I side). As described earlier, the drum jig 1 is designed such that the pitch p1 of the positioning pins 6 is several micrometers smaller than the pitch p2 of the guide holes. This is a value which ensures that the positioning pin engages with the guide hole h on its end portion on the entry point I side. Thus, as the positioning pins are located closer to the entry point I side, the engagement positions of the positioning pins are closer to a front F side, and the engagement is ensured even on the entry point I side. In other words, in this state, an end portion of the guide hole h5 is not in contact with the positioning pin 6.

In this embodiment, at the same time that the guide hole h4 exits by the movement of the metal member 11, the brake unit 15 puts a brake put on the drum jig 1, causing the drum jig 1 and the metal member 11 to slide on each other by an amount equal to a pitch difference per pitch (several micrometers) until the positioning pin 6 comes into contact with the end portion of the guide hole h5. In other words, while the metal member 11 moves, the endmost positioning pin 6 of the drum jig 1 on the exit point O side is always in contact with the end portion of the corresponding hole h on the rear B side.

Figure 11D:
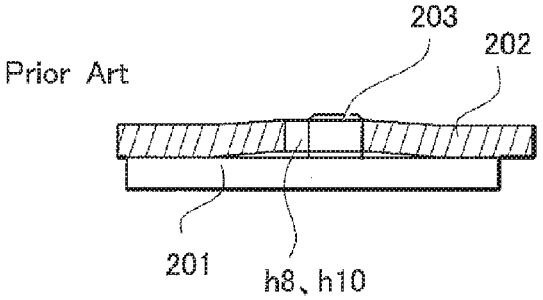
FIG. 11D is an enlarged top view thereof.

Referring to FIG. 11B showing the conventional structure, when no brake is put on the drum jig 201, the drum jig 201 rotates at the circumferential velocity equivalent to the moving velocity of the metal member 202. In this case, even after the guide hole h4 exits by the movement of the metal member 202, the drum jig 201 and the metal member 202 do not slide on each other; therefore, the guide hole h5 does not come into contact with the positioning pin 203. More specifically, as the metal member 202 moves, the engagement positions of the positioning pins 203 are shifted more and more toward the front F side (the exit point O side) of the guide holes h. Further, as the metal member 202 moves on, the pitch differences are accumulated, and consequently, the endmost positioning pin 203 on the entry point I side comes into contact with the front F side of the guide hole h, separating the metal member 202 from the drum jig 201 (FIG. 11D).

In this embodiment, the brake unit (not shown in FIG. 3) applies a load to the rotary shaft 2 to make the average circumferential velocity v1 of the drum jig 1 lower than the moving velocity v2 of the metal member 11. Moreover, the load applied by the brake unit to the rotary shaft 2 is a load larger than a force with which the metal member 11 and the drum jig 1 in contact with each other move in the opposite directions (one being a direction indicated by the broken-line arrow) (i.e., they slide on each other) but not larger than a force causing deformation of the metal member 11.

Thereby, the metal member 11 and the drum jig 1 can be slid in the relatively opposite directions (one being the direction indicated by the broken-line arrow) within the clearance between the positioning pin 6 and the guide hole h (e.g., about 0.5 mm). Consequently, the accumulated pitch differences between them can be cancelled.

Specifically, the positioning pins 6 can be ensured to engage with the guide holes h8 and h10 with which they conventionally fail to engage.

In this way, the accumulated pitch difference between the guide holes h and the positioning pins 6 is cancelled continually while the elongated metal member 11 is being plated, and therefore does not exceed the clearance between them. Thus, variations in the thickness of the plated films formed by spot plating can be reduced.

Further, in this embodiment, since the pitch p1 of the positioning pins 6 is smaller than the pitch p2 of the guide holes h, biting (deformation) can be prevented in the guide hole h closest to the entry point I of the drum jig 1 and the guide hole h closest to the exit point O of the drum jig 1.

Referring to FIGS. 3A, 3C, and 3D, when a load is applied by the brake unit to the drum jig 1, the engagement position of the positioning pin 6 in the guide hole h10 closest to the entry point I is shifted from the center of the guide hole h10 toward the front side F in the travelling direction, making the clearance on the rear side B large (FIG. 3C).

Similarly, the engagement position of the positioning pin 6 in the guide hole h4 closest to the exit point O is shifted toward the rear side B in the travelling direction, making the clearance on the front F side large (FIG. 3D).

In this embodiment, this state is maintained from the head to the tail of the metal member 11. Thereby, biting on the guide holes h at the entry point I and the exit point O can be prevented.

Although the brake unit 15 is constantly applying a certain load to the drum jig 1, the drum jig 1 and the metal member 11 do not necessarily slide on each other all the time.

For example, in FIG. 3A, the guide hole h4 closest to the exit point O is in contact with the positioning pin at its rear side, and in this case, a relation (a static frictional force acting between the drum jig 1 and the metal member 11)+(a force with which the guide hole h closest to the exit point O pushes the positioning pin 6)>(load applied by the brake unit 15) holds true. Thus, the drum jig 1 and the metal member 11 move at the same velocity, and do not slide on each other.

In contrast, at the moment when the metal member 11 moves on to cause the positioning pin 6 to exit the guide hole h4 closest to the exit point O and make the next guide hole h5 the one closest to the exit point O, (a static frictional force acting between the drum jig 1 and the metal member 11)<(load applied by the brake unit 15)

holds true (since h5 and the positioning pin are not in contact at this point). Thus, the drum jig 1 and the metal member 11 slide on each other, slowing down the drum jig 1.

Then, at the moment when the positioning pin 6 comes into contact with the rear side of the guide hole h5, a relation (a static frictional force acting between the drum jig 1 and the metal member 11)+(a force with which the guide hole h closest to the exit point O pushes the positioning pin 6)>(a load applied by the brake unit 15)

holds true again, and the drum jig 1 and the metal member 11 move at the same velocity.

In other words, while the drum jig 1 and the metal member 11 move at the same velocity, the drum jig 1 slows down instantaneously every time the positioning pin 6 exits the guide hole h. Each sliding distance is equals to a pitch difference per pitch.

FIG. 4 shows a comparison between results of plating performed using the partial plating apparatus 10 of this embodiment and results of plating performed using a partial plating apparatus 200, shown in FIG. 5, having a conventional structure.

Figures 4A, 4B:
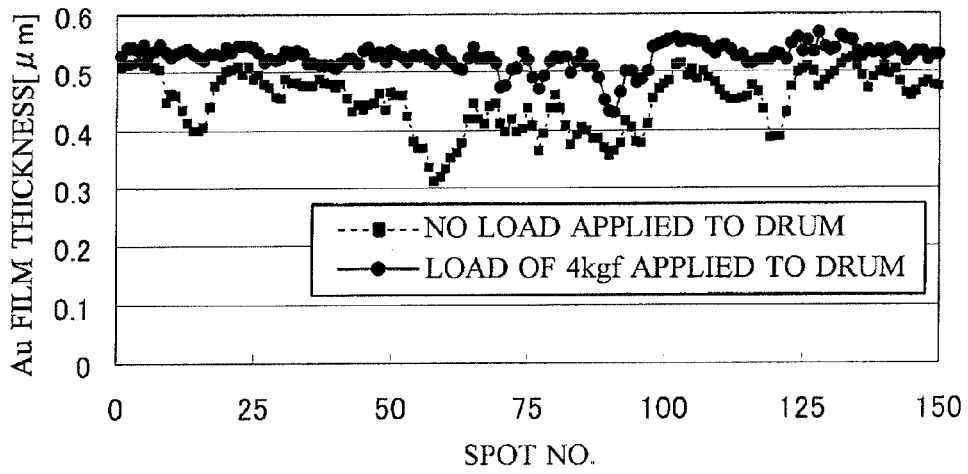
FIG. 4A is a characteristics chart showing a comparison between plated-film thickness variations of the partial plating apparatus according to the first embodiment of the present invention and plated-film thickness variations of a partial plating apparatus having a conventional structure.
FIG. 4B is a comparison table therefor.
Figure 10:
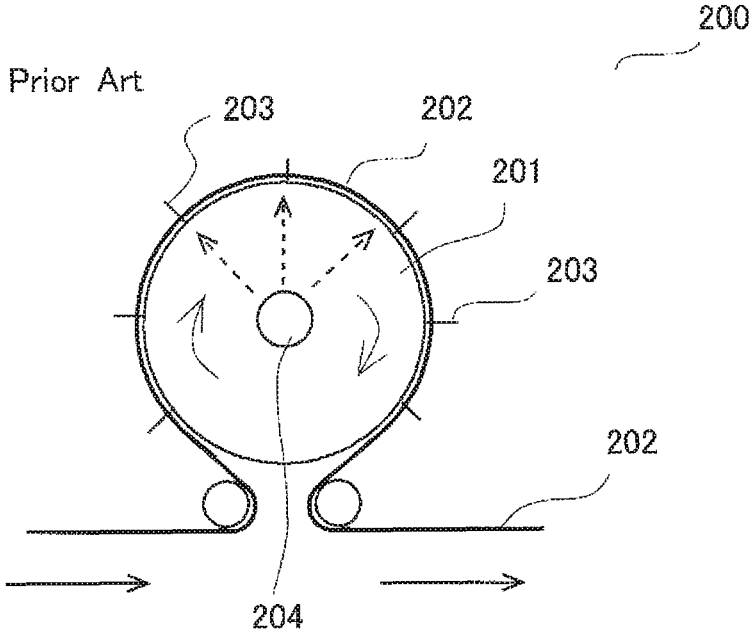
FIG. 10 is a top view illustrating the conventional structure.

In FIG. 4A, the vertical axis denotes the thickness [μm] of plated films (Au), and the horizontal axis denotes the serial numbers of the plated spots (150 spots). The solid line represents the spot plating by the partial plating apparatus 10 of this embodiment, and the broken line presents the spot plating by the partial plating apparatus 200 having the conventional structure (FIG. 10). Both apparatuses performed plating processing at the same current density, and the plated-film thickness of each plated spot was measured at a center portion thereof.

As is clear from this graph, the partial plating apparatus 10 of this embodiment clearly achieved reduction in the variations in the plated-film thickness, compared to the conventional one.

Specifically, referring to the comparison table in FIG. 4B, the range (Range) between the maximum value and the minimum value of the plated-film thicknesses is reduced from the conventional value 0.21 μm to 0.14 μm. Moreover, the standard deviation (σ) is 0.022 in this embodiment while that for the conventional apparatus is 0.049. As can be seen from this result, the film-thickness variations were drastically reduced.

Next, a second embodiment of the present invention is described with reference to FIGS. 5 to 8. In the second embodiment, a region on the metal member 11 for performing plating processing is narrowed relative to that in the first embodiment. Note that components which are the same as those in the first embodiment are denoted by the same reference numerals used in the first embodiment, and are not described again here.

Figure 5A:
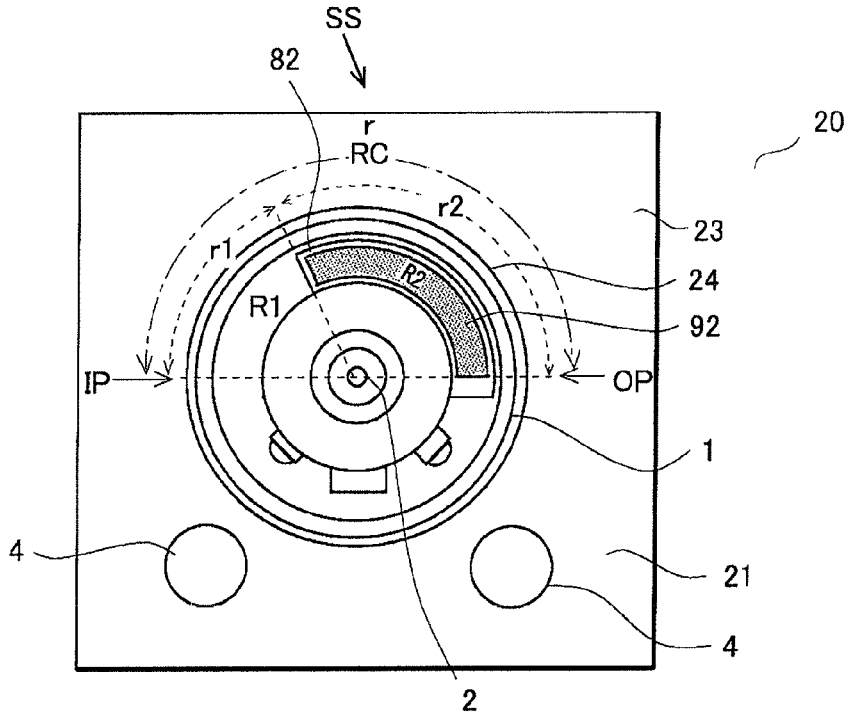
FIG. 5A is a top view of a partial plating apparatus according to a second embodiment of the present invention.
Figure 5B:
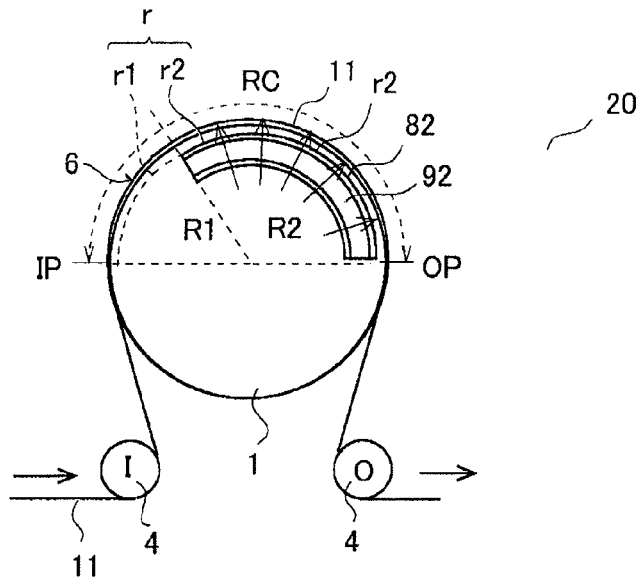
FIG. 5B is a schematic top view showing how a metal member is transported by a drum jig.

FIG. 5 shows schematic diagrams of a partial plating apparatus 20. Specifically, FIG. 5A is a top view corresponding to FIG. 1A, FIG. 5B is a schematic top view (corresponding to FIG. 2A) showing a state where a metal member 11 is transported on a drum jig 1.

Referring to FIGS. 5A and 5B, as described earlier, the metal member 11 is transported along an outer circumferential portion of the drum jig 1. Hereinbelow, a portion of the outer circumference of the drum jig 1 which is in contact with the metal member 11 is called and described as a contact region RC.

In a top view of the drum jig 1 (where the diameter of the drum jig 1 can be seen in a plan view and the shape of the drum jig 1 is visible as being substantially circular), the contact region RC of this embodiment is a region in contact with the metal member 11 over substantially the semi-circumference of the drum jig 1, and is a region extending from their first contact point IP on an entry side I for the metal member 11 (an entry-side end portion) to an exit-side end portion OP where they come out of the contact on an exit side O. Although the contact region RC extends over substantially the semi-circumference as an example, the contact region RC may be a region larger than this (exceeding the semi-circumference). Further, since the drum jig 1 and the metal member 11 move with time, the contact region RC is not a particular (fixed) region of the drum jig 1 and the metal member 11, but is a region where any portion of the outer circumference of the drum jig 1 and any portion of the metal member 11 come into contact while the drum jig 1 and the metal member 11 are moving (rotating) relative to each other.

In this embodiment, for convenience of illustration, the contact region RC is divided into a first region R1 and a second region R2. The first region R1 is a region of the contact region RC extending from the entry-side end portion IP of the metal member 11 (a start point of the contact region RC) to a position shifted therefrom forward in the travelling direction of the metal member 11 by a predetermined distance (a first arc r1). The second region R2 is a region extending from an end portion of the first region R1 to the exit-side end portion OP of the metal member 11 (an end point of the contact region RC). Then, the partial plating apparatus 20 has a structure in which the metal member 11 is not plated in the first region R1, and the metal plate is plated in the second region R2.

Specifically, in the top view (plan view) in FIG. 5, a jet portion 82 has a fan shape whose arc is smaller than the ark r of the semicircle of the drum jig 1 (the contact region RC), and anodes 92 also have a similar fan shape. The jet portion 82 and the anodes 92 are arranged such that their arcs are along the arc (a second arc r2) of the second region R2.

Figure 6:
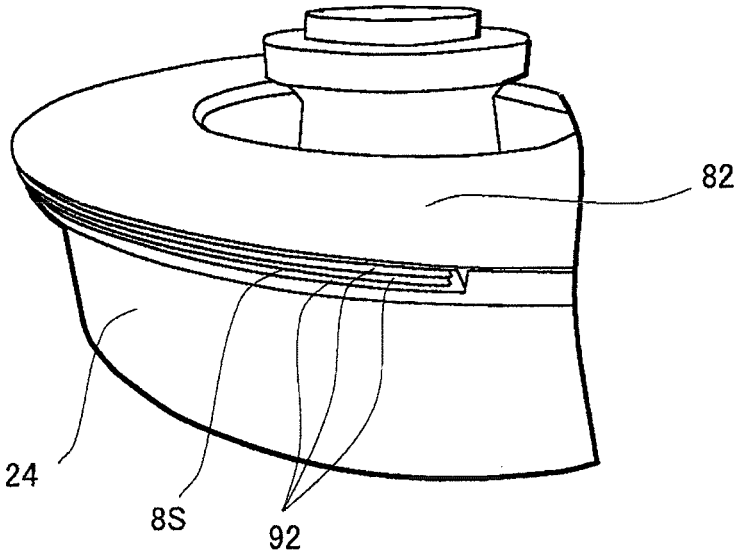
FIG. 6 is a perspective view illustrating the partial plating apparatus according to the second embodiment of the present invention.

FIG. 6 is a perspective view seen in an SS-direction point of view in FIG. 5A.

The jet portion 82 ejects a plating solution from an ejection vent (slit portion 8S) shown in FIG. 6. In this embodiment, the anodes 92 are fan-shaped, and for example, the plate-shaped anodes 92 are arranged at an upper portion and a lower portion of the slit portion 8S. The structure described above allows the metal member 11 not to be plated in the first region R1 and to be plated in the second region R2 (see FIG. 5B).

Figure 7A:
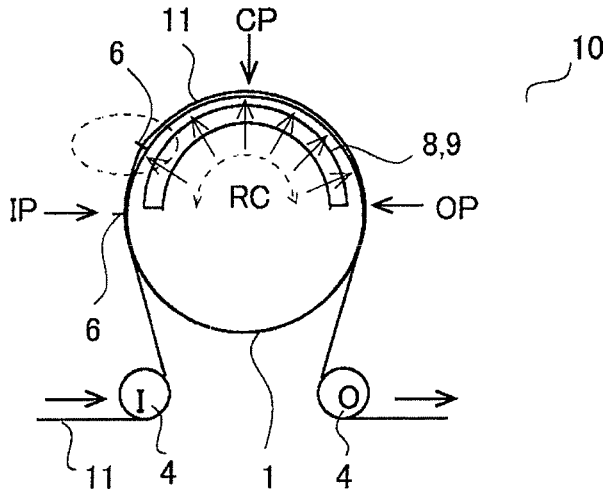
FIG. 7A is a top view illustrating the partial plating apparatus of the first embodiment of the present invention.
Figure 7B:
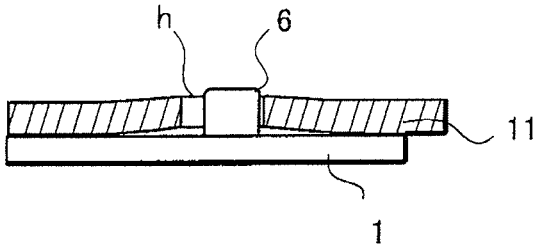
FIG. 7B is a spread-out top view thereof.
Figure 7C:
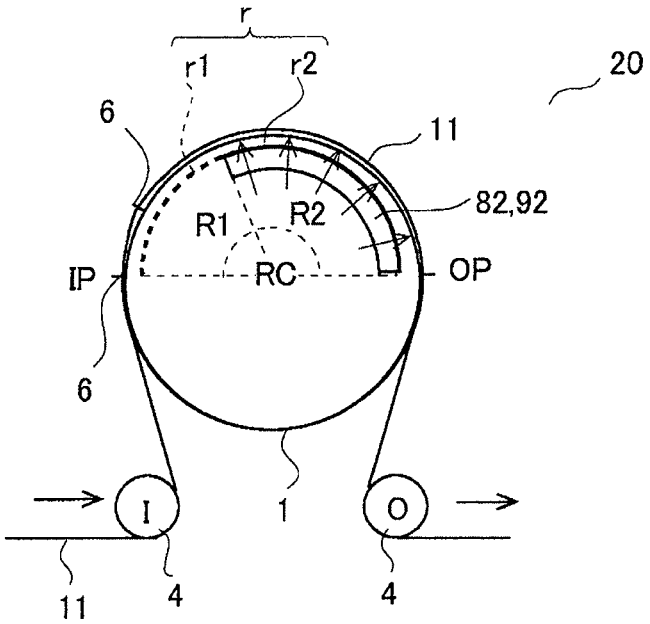
FIG. 7C is a top view illustrating the partial plating apparatus according to the second embodiment of the present invention.

The reason for narrowing the region for plating the metal member 11 is described with reference to FIG. 7. FIG. 7A is a top view corresponding to FIG. 2A, illustrating an overview of the partial plating apparatus 10 of the first embodiment. FIG. 7B is an enlarged view of a portion circled by the broken line in FIG. 7A, and FIG. 7C is a top view illustrating an overview of the partial plating apparatus 20 of the second embodiment.

Referring to FIG. 7A, the metal member 11 moves while their guide holes engage with positioning pins 6 of the drum jig 1, as already described. The entry-side end portion IP of the contact region RC is a portion where the metal member 11 first comes into contact with the drum jig 1, and at this position, a force exerted by the metal member 11 on the drum jig 1 is 0 (zero).

In this state, if the positioning pin 6 comes into contact with a side wall (inner wall) of the corresponding guide hole at the entry-side end portion IP, a frictional force produced therebetween might lift the metal member 11 slightly away from the outer circumferential surface of the drum jig 1 (the contact between the positioning pin 6 and the guide hole keeps the positioning pin 6 from entering all the way through the guide hole) (see the portion circled by the broken line in FIG. 7A and FIG. 7B).

Further, also in a case where the positioning pin 6 comes into contact with a side wall (inner wall) of the corresponding guide hole in the immediate vicinity of the entry-side end portion IP, if the force exerted by the metal member 11 on the drum jig 1 is negligibly small relative to the frictional force acting between the positioning pin 6 and the guide hole h, the metal member 11 might be similarly lifted away from the outer circumferential surface of the drum jig 1.

The force exerted by the metal member 11 on the drum jig 1 is maximum at a middle portion CP between the entry-side end portion IP and the exit-side end portion OP of the contact region RC (at the peak portion in FIG. 7A). In other words, the force exerted by the metal member 11 on the drum jig 1 is minimum (zero) at the entry-side end portion IP, and becomes larger and larger toward the middle point CP.

Thus, in the first region R1 which starts from the entry-side end portion IP as described earlier, the force exerted by the metal member 11 on the drum jig 1 is smaller than the frictional force between the positioning pin 6 and the guide hole. Thus, if the metal member 11 is lifted away from the drum jig 1, this lifted state may continue. On the other hand, when the force exerted by the metal member 11 on the drum jig 1 gradually increases toward the middle point CP as the drum jig 1 rotates, and exceeds the frictional force between the guide hole and the positioning pin 6, the guide hole and the positioning pin 6 engage with each other, cancelling the state where the metal member 11 is lifted away from the drum jig 1.

To be more specific, looking at the overall contact region RC, in the first half of the contact region RC starting from the entry-side end portion IP (the first region R1), the drum jig 1 may rotate with the metal member 11 being partly lifted from the drum jig 1, as shown in the broken-line circle in FIG. 7A. If the metal member 11 is plated in this state by being supplied with a plating solution from the jet portion 8, variations in the thickness of the plated films occur, leading to a problem where the distribution of the thickness of plated films on the metal member 11 becomes uneven as a whole.

Thus, as shown in FIG. 7C, in the partial plating apparatus 20 of the second embodiment, the plating processing is performed in the second region R2 where the force exerted by the metal member 11 on the drum jig 1 exceeds the frictional force between the positioning pin 6 and the guide hole, and the metal member 11 is no longer lifted from the drum jig 1. Thereby, the distribution of the thickness in the plated films can be evened.

Here, the first region R1 and the second region R2 are further described.

In visual definitions, the first region R1 is a region forming a first arc r1 (indicated by the thick broken line) extending along the outer circumference of the drum jig 1, and the second region R2 is a region forming the second arc r2 (indicated by the solid line) extending along the outer circumference of the drum jig 1. The length of the arc r1 is smaller than that of the second arc r2.

A specific description is given using an example. The length of the first arc r1 is from one fourth (r1=r/4) to one third (r1=r/3) of the overall arc r. The first region R1 is a region forming the first arc r1 from the entry-side end portion IP in the travelling direction of the metal member 11.

Then, the jet portion 82 and the counter electrodes (anodes) 92 are provided only in the second region R2. Specifically, they are each formed into a fan shape in a top view (plan view) to form an arc along the second arc r2 of the second region R2. Thereby, the metal member 11 is subjected to the plating processing only in the second region R2 of the contact region RC, and this contributes to evening of the thickness of the plated films.

FIG. 8 shows a comparison between results of plating processing performed using the partial plating apparatus 20 of the second embodiment shown in FIG. 6 and results of plating processing performed using the partial plating apparatus 10 of the first embodiment shown in FIG. 1. The results for the partial plating apparatus 10 of the first embodiment are the same as those shown in FIG. 4. Note that in the partial plating apparatus 20 of the second embodiment, the first region R1 is formed such that the length of the first arc r1 is one third of the overall contact region RC, and the jet portion 82 and the counter electrodes 92 which are fan-shaped are provided in the second region R2.

Figures 8A, 8B:
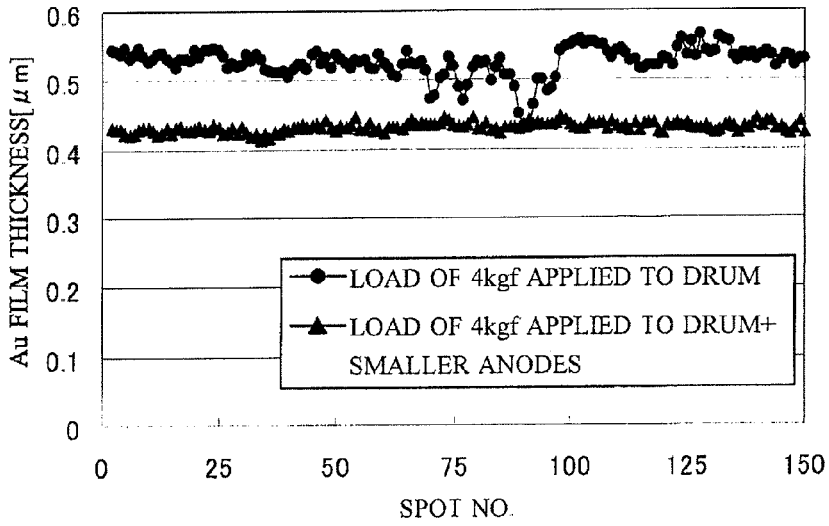
FIG. 8A is a characteristics chart showing a comparison between plated-film thickness variations of the partial plating apparatus according to the second embodiment of the present invention and plated-film thickness variations of the partial plating apparatus according to the first embodiment.
FIG. 8B is a comparison table thereof.

In FIG. 8A, the vertical axis denotes the thickness [μm] of plated films (Au), and the horizontal axis denotes the serial numbers of the plated spots (150 spots). The triangular sports represent the spot plating by the partial plating apparatus 20 of the second embodiment, and the circular spots represent the spot plating by the partial plating apparatus 10 of the first embodiment (FIG. 1). The plated-film thickness of each plated spot was measured at a center portion thereof.

As is clear from this graph, the partial plating apparatus 20 of the second embodiment achieved reduction in the variations in the plated-film thickness, compared to the partial plating apparatus 10 of the first embodiment.

Specifically, referring to the comparison table in FIG. 8B, the range (Range) between the maximum value and the minimum value of the plated-film thicknesses is reduced from 0.14 μm of the first embodiment to 0.03 μm. Moreover, the standard deviation (σ) of the second embodiment is 0.006 while that for the first embodiment is 0.022. As can be seen from this result, the film-thickness variations were drastically reduced.

The target value of the average film thickness (Ave) was set to 0.5 μm for the partial plating apparatus 10 of the first embodiment and to 0.45 μm for the partial plating apparatus 20 of the second embodiment.

Figure 9:
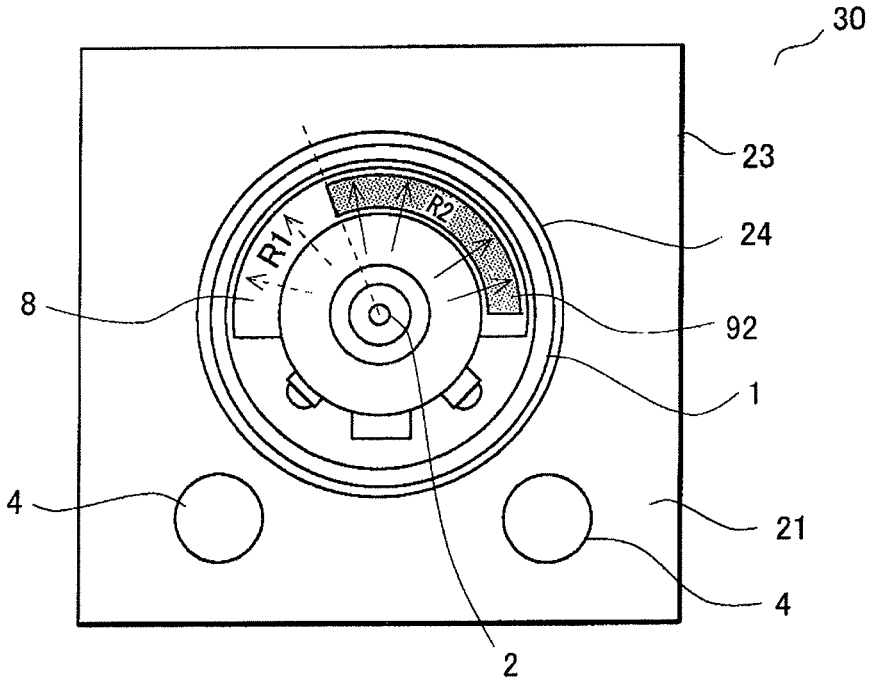
FIG. 9 is a top view illustrating a partial plating apparatus according to a third embodiment of the present invention.

FIG. 9 is a diagram showing a partial plating apparatus 30 of a third embodiment of the present invention, and is a top view corresponding to FIG. 1A. The same components as those in the first and second embodiments are denoted by the same reference numerals as those in the first and second embodiments, and are not described again here.

A metal member 11 may be plated only in a second region R2. To be more specific, a jet portion 8 is formed into a substantially semicircular shape as in the first embodiment, and only counter electrodes 92 may be formed into a fan shape. In this case, even though a plating solution is supplied from the jet portion 8 in the first region R1, no plating is performed there since there are no counter electrodes 92 (indicated by the broken-line arrows). The plating is performed only in the second region R2 (indicated by the solid-line arrows). Thus, the same advantageous effects as those offered by the second embodiment can be obtained. Other configurations are the same as those in the second embodiment.

Note that an even distribution may be obtained for the thickness in the plated films even when the length of the first arc r1 of the first region R1 is shorter than that in the above-described example (e.g., even when r1=r/5).

In the partial plating apparatus 20 of this embodiment, the plating could be performed with an even film-thickness distribution by making one third of the overall contact region RC the first region R1 (see FIG. 7).

On the other hand, even if the length of the first arc r1 extends beyond the middle point CP of the contact region RC, the plated-film thickness distribution is even in the second region R2. However, if the first arc r1 is too long (or the second region R2 is too small), an area which can be plated is reduced, lowering the productivity. For this reason, it is preferable that the first region R1 is as small as possible. For this reason, in this embodiment, the first region R1 is a region in which the length of the first arc r1 is one third of the overall arc r of the contact region RC.

As described above, a partial plating method of this embodiment performs partial plating on the metal member 11 transported along the outer circumferential portion of the drum jig 1 of the partial plating apparatus. Specifically, the metal member 11 is not plated in the first region R1 of the contact region RC where the metal member 11 is in contact with part of the outer circumferential portion of the drum jig 1, the first region R1 extending from the entry-side end portion IP for the metal member 11 to a position away therefrom by a predetermined distance. Then, the metal member 11 is plated in the second region R2 extending from the end portion of the first region R1 to the exit-side end portion OP for the metal member 11.

As described above, the film-thickness variations are likely to occur in the first half of the contact region RC after the entry-side end portion IP (the first region R1), and this is also true in the conventional structure. To be more specific, for example, even if a partial plating apparatus does not include the brake unit 15 as the partial plating apparatuses 10 to 30 of the above embodiments do, the film-thickness variations are likely to be poor in the first half of the contact region RC.

However, according to the partial plating method of this embodiment, the metal member 11 is plated not in the first half (the first region R1) of the drum jig 1 having a poor film-thickness distribution, but only in the second region R2. Hence, variations in the film-thickness distribution can be reduced compared to a plating method performing plating over the entire contact region RC.

REFERENCE SIGNS LIST

1 drum jig
2 rotary shaft
3 opening portion
4 support roll
5 belt
6 positioning pin
8, 82 jet portion
9, 92 counter electrode (anode)
10, 20, 30, 40, 50 partial plating apparatus
11 metal member (member to be plated)
15 brake unit
h, h1 to h10 guide hole
RC contact region
R1 first region
R2 second region
r1 first arc
r2 second arc

The invention claimed is:

1. A partial plating apparatus comprising:

a drum jig having a plurality of positioning pins arranged on an outer circumferential portion thereof so that a metal member engages with the positioning pins and is transported along the outer circumferential portion, part of the outer circumferential portion of the drum jig is a contact region where the drum jig is in contact with the metal member and which has a first region and a second region, the first region extending over a predetermined distance from an end portion of the contact region on a side where the metal member enters, the second region extending from an end portion of the first region to an end portion of the contact region on a side where the metal member exits, the metal member is not plated in the first region, the metal member is plated in the second region, counter electrodes are provided only in the second region a rotary shaft configured to support the drum jig such that the drum jig is rotatable;

a jet portion configured to supply a plating solution to the metal member; and a brake attached to the rotary shaft and configured to reduce a circumferential velocity of the drum jig.

2. The partial plating apparatus according to claim 1, wherein the brake applies a load to the rotary shaft to make the circumferential velocity lower than a moving velocity of the metal member.

3. The partial plating apparatus according to claim 2, wherein the load is a load larger than a force with which the metal member and the drum jig that are in contact with each other move in opposite directions, but smaller than a force causing deformation of the metal member.

4. The partial plating apparatus according to claim 1, wherein the brake applies the load to the rotary shaft pneumatically.

5. The partial plating apparatus according to claim 1, wherein a pitch of the positioning pins is smaller than a pitch of a plurality of guide holes provided in the metal member for the engagement with the positioning pins.

6. The partial plating apparatus according to claim 1, wherein the first region and the second region are regions forming a first arc and a second arc, respectively, along an outer circumference of the drum jig, and a length of the first arc is smaller than that of the second arc.

7. The partial plating apparatus according to claim 1, wherein the first region is a region where a force exerted by the metal member on the drum jig is equal to or smaller than a frictional force acting between the positioning pins and the guide holes.

8. The partial plating apparatus according to claim 1, wherein the first region is a region extending over one fourth to one third of the entire contact region.

9. The partial plating apparatus according to claim 1, wherein the jet portion ejects the plating solution only to the second region.

10. A partial plating method for performing partial plating on a metal member transported along an outer circumferential portion of a drum jig of a partial plating apparatus, the partial plating method comprising:

rotating the drum jig along with movement of the metal member while causing a plurality of positioning pins provided on the drum jig to engage with a plurality of guide holes provided in the metal member; and applying a load to a rotary shaft of the drum jig so that a circumferential velocity of the drum jig is lower than a movement velocity of the metal member by a brake attached to the rotary shaft, the brake configured to reduce the circumferential velocity of the drum jig, wherein part of the outer circumferential portion is a contact region where the drum jig is in contact with the metal member and which has a first region and a second region, the first region extending from an end portion of the contact region on a side where the metal member enters the contact region, to a position shifted forwardly of the end portion by a predetermined distance, the second region extending from the position in the first region of the contact region to an end portion of the contact region on a side where the metal member exits the contact region, the metal member is not plated in the first region, and the metal member is plated in the second region via application of a voltage between the metal member and a counter electrode.

11. The partial plating method according to claim 10, wherein the first region and the second region are regions defining a first arc and a second arc, respectively, along an outer circumference of the drum jig, and a length of the first arc is smaller than a length of the second arc.

12. The partial plating method according to claim 10, wherein the first region is a region where a force exerted by the metal member on the drum jig is equal to or smaller than a frictional force acting between the plurality of positioning pins provided on the drum jig and the plurality of guide holes provided in the metal member.

13. The partial plating method according to claim 10, wherein the first region is a region extending over one fourth to one third of the entire contact region.

14. The partial plating method according to claim 10, wherein the load is a load larger than a force with which the metal member and the drum jig, in contact with each other, move in opposite directions, but smaller than a force causing deformation of the metal member.

15. The partial plating method according to claim 11, wherein the load is a load larger than a force with which the metal member and the drum jig, in contact with each other move in opposite directions, but smaller than a force causing deformation of the metal member.

16. The partial plating method according to claim 10, wherein the load applied to the rotary shaft of the drum jig by the brake is set to cancel the accumulated pitch difference between the guide hole of the metal member and the positioning pin of the drum jig.

17. The partial plating method according to claim 10, wherein plating does not occur in any of the first region and plating occurs throughout the second region.

* * * * *